US006907700B2

(12) United States Patent
Geraud

(10) Patent No.: US 6,907,700 B2
(45) Date of Patent: Jun. 21, 2005

(54) FLOOR WITH FLOATING SUPPORT

(75) Inventor: Pierre Geraud, Rennes (FR)

(73) Assignee: Tarkett Sommer, Nanterre (FR)

( * ) Notice: Subject to any disclaimer, the term of this patent is extended or adjusted under 35 U.S.C. 154(b) by 0 days.

(21) Appl. No.: 10/471,867

(22) PCT Filed: Mar. 15, 2001

(86) PCT No.: PCT/FR01/00774

§ 371 (c)(1),
(2), (4) Date: Jan. 12, 2004

(87) PCT Pub. No.: WO02/075075

PCT Pub. Date: Sep. 26, 2002

(65) Prior Publication Data

US 2004/0103602 A1 Jun. 3, 2004

(51) Int. Cl.[7] ..... F04B 9/00
(52) U.S. Cl. ..... 52/480; 52/483.1; 52/384; 52/411; 52/403.1; 52/391; 52/390
(58) Field of Search ..... 52/483.1, 384, 52/480, 411, 403.1, 409, 391, 390

(56) References Cited

U.S. PATENT DOCUMENTS

| | | | | | |
|---|---|---|---|---|---|
| 4,682,459 | A | * | 7/1987 | Stephenson | 52/390 |
| 4,694,627 | A | | 9/1987 | Omholt | 52/390 |
| 5,016,413 | A | * | 5/1991 | Counihan | 52/391 |
| 5,299,401 | A | * | 4/1994 | Shelton | 52/393 |
| 5,497,590 | A | * | 3/1996 | Counihan | 52/385 |
| 5,906,082 | A | * | 5/1999 | Counihan | 52/403.1 |
| 6,164,031 | A | * | 12/2000 | Counihan | 52/480 |
| 6,688,065 | B2 | * | 2/2004 | Chambers | 52/480 |

FOREIGN PATENT DOCUMENTS

| | | |
|---|---|---|
| DE | 1534757 | 11/1969 |
| FR | 1434111 | 2/1966 |
| FR | 2798687 | 3/2001 |

OTHER PUBLICATIONS

BNi Construction Dictionary, 2001, BNi Publications, Inc., 357.*

* cited by examiner

*Primary Examiner*—Carl D. Friedman
*Assistant Examiner*—Steve Varner
(74) *Attorney, Agent, or Firm*—Jacobson Holman PLLC

(57) ABSTRACT

Flooring made up of a set of touching parallel floorboards is supported by a set of mutually parallel load-spreading plates placed on the ground via a resilient underlayer on which they rest. The flooring is remarkable by the fact that the floorboards are stuck to the plates by means of beads of elastically-deformable adhesive such as polyurethane placed on the top faces of the plates, preferably in respective longitudinal grooves formed in the top face of the plates.

16 Claims, 2 Drawing Sheets

FLOOR WITH FLOATING SUPPORT

This is a nationalization of PCT/FR01/00774 filed Mar. 15, 2001 and published in French.

BACKGROUND OF THE INVENTION

1. Field of the Invention

The present invention relates to flooring with floating support.

It relates more particularly to flooring made up of a set of touching parallel floorboards which are supported by a set of mutually parallel load-spreading plates that are themselves laid on the ground via a resilient underlayer on which they rest.

2. Description of the Related Art

The type of flooring that includes touching parallel floorboards supported by a set of mutually parallel load-spreading plates that are themselves laid on the ground via a resilient underlayer on which they rest is well known.

Traditionally, two major categories of flooring made in this way are distinguished.

A first category referred to as "solid" flooring comprises individual narrow floorboards or planks of solid wood.

The other category, referred to as "multi-ply" flooring, is made up of floorboards of greater width having a multilayer structure. More precisely, such a floorboard comprises on top a sheet of high quality wood bonded to a central core of plywood or ordinary wood, in turn bonded to a baseplate of ordinary wood.

Solid flooring is laid on battens disposed transversely relative to the direction in which the floorboards extend.

Multi-ply flooring is sometimes laid on plates of width considerably greater than that of the battens, said plates being oriented at 45°, or substantially 45°, relative to the longitudinal direction of the floorboards.

The function of the plates is to absorb the loads to which the flooring is subjected in use by spreading them out so as to avoid breaking the tongues that provide bonding between adjacent floorboards.

This problem of tongues being stressed and broken is clearly greater with multi-ply floorboards since they are generally of a width that is some multiple of the width of a solid floorboard, thereby multiplying in proportion the torque which the tongue must be capable of withstanding.

Flooring made in this way is laid on the load-spreading plates without adhesive (in floating manner).

In certain applications, in particular when making floors for sporting activities, the plates are placed on the ground, not directly, but with a resilient underlayer being interposed, e.g. made of synthetic felt or foam.

This provides flooring that is flexible and elastic, and particularly suitable for playing certain sports such as handball or basketball, for example.

Due to variations in the humidity of the ambient air, this kind of flooring is subjected to cyclical phenomena of expansion and contraction of its area, and in the long run that can give rise to breaks in the interfitting tongue and groove systems, and/or can lead to undesirable gaps appearing between adjacent floorboards.

This problem is associated with a poor distribution of internal tensions which, for large areas of flooring, can lead to the above-mentioned difficulties.

SUMMARY OF THE INVENTION

The invention relates to floating multi-ply flooring.

An object of the invention is to provide a solution to the above-mentioned problem by means of an arrangement which is extremely simple, which increases the cost price of the flooring very little if at all, and which is easy to implement while laying the flooring.

According to the invention, this object is achieved because of the fact that said floorboards are stuck to said plates by means of beads of elastically-deformable adhesive, such as polyurethane, disposed on the top faces of the plates.

Furthermore, according to certain additional, non-limiting characteristics of the invention:

said beads of adhesive are received in longitudinal grooves formed in the top faces of the plates;

said grooves are substantially rectilinear in section, being dimensioned in such a manner that after the bead of adhesive has been flattened and has set, it occupies a fraction of the inside space of the groove in which it is received;

the plate is provided with a single middle groove;

said plates are oriented in such a manner as to form an acute angle relative to the longitudinal direction of the floorboards;

said angle has a value of about 45°; and the floorboards are assembled to one another by a tongue-and-groove engagement system, possibly together with glue.

Other characteristics and advantages of the invention appear from the description given below with reference to the accompanying drawings which show one possible embodiment of the invention merely by way of non-limiting example.

BRIEF DESCRIPTION OF THE DRAWINGS

In the drawings:

In FIG. 4, the floorboards of the flooring are drawn in chain-dotted lines.

DETAILED DESCRIPTION OF THE PREFERRED EMBODIMENTS

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The flooring shown in FIGS. 1 to 5 is a "multi-ply" horizontal floor referenced 1 made up of an assembly of touching floorboards 10.

Figure 5:
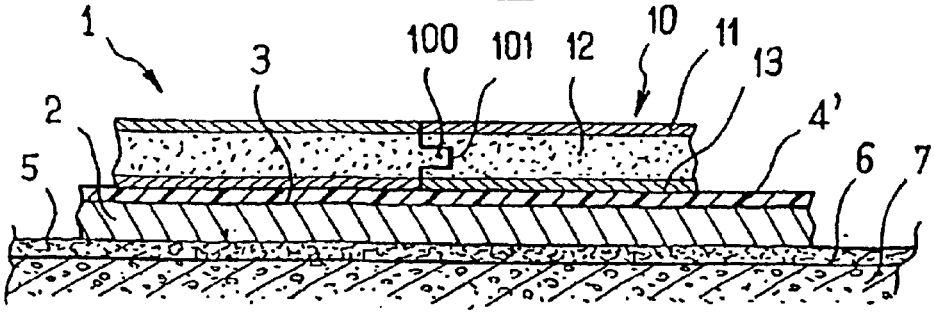
FIG. 5 is a section view on the plane referenced V—V of FIG. 4.

As can be seen in FIG. 5, each floorboard is made up of three layers, a top sheet 11, a core 12, and a bottom sheet 13.

As an indication, this floorboard is 2.40 meters (m) long, 180 millimeters (mm) wide, and 15 mm thick.

Traditionally, the top face of the top sheet reproduces a flooring strip in a design representing individual floorboards, thus giving the appearance of conventional flooring.

As shown in FIG. 5, two adjacent floorboards 10 are assembled together by a conventional interfitting system comprising a tongue 100 and a groove 101, advantageously with the tongue glued in the groove.

The flooring 1 is laid on a set of load-spreading plates 2.

These are plates of wood disposed parallel to one another and spaced apart to a certain extent.

As an indication, these plates are 2.50 m long, 0.50 m wide, and 10 mm thick.

Figure 4:
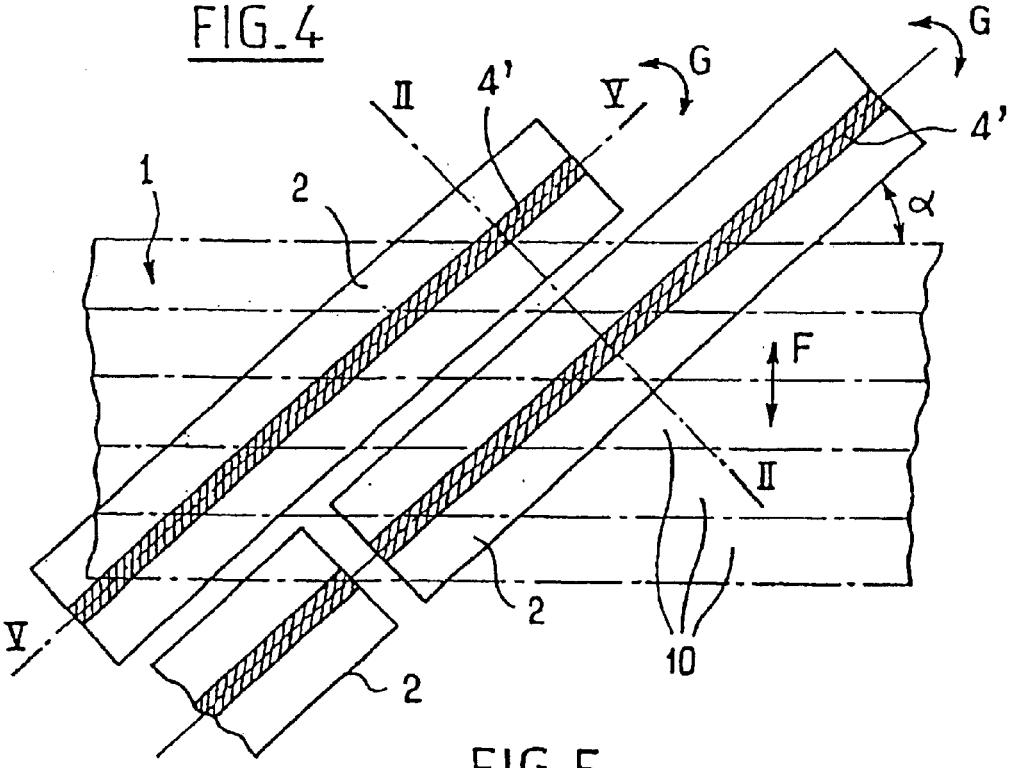
FIG. 4 is a diagrammatic and fragmentary plan view of the flooring.

According to a characteristic of the invention, the plates are placed in a staggered configuration, as can be seen in particular in FIG. 4, so as to form rows, the rows extending in such a direction as to form an acute angle $\alpha$ with the longitudinal direction of the floorboards 10.

This angle is preferably equal to 45° or is close to that value.

In well known manner, the plates 2 are laid indirectly on the ground 7, in this case on a horizontal slab of concrete.

In fact, they rest on a resilient underlayer 5 such as a synthetic foam which itself rests on a vapor-barrier film 6, e.g. of polyethylene.

In the top face of each plate 2 there is formed a longitudinally extending middle groove 3.

This is a shallow groove of rectilinear section, and by way of indication it may be about 1 mm deep.

According to an essential characteristic of the invention, a bead of elastically-deformable adhesive 4, e.g. made of single-component polyurethane, is placed in the groove 3.

Figure 1:
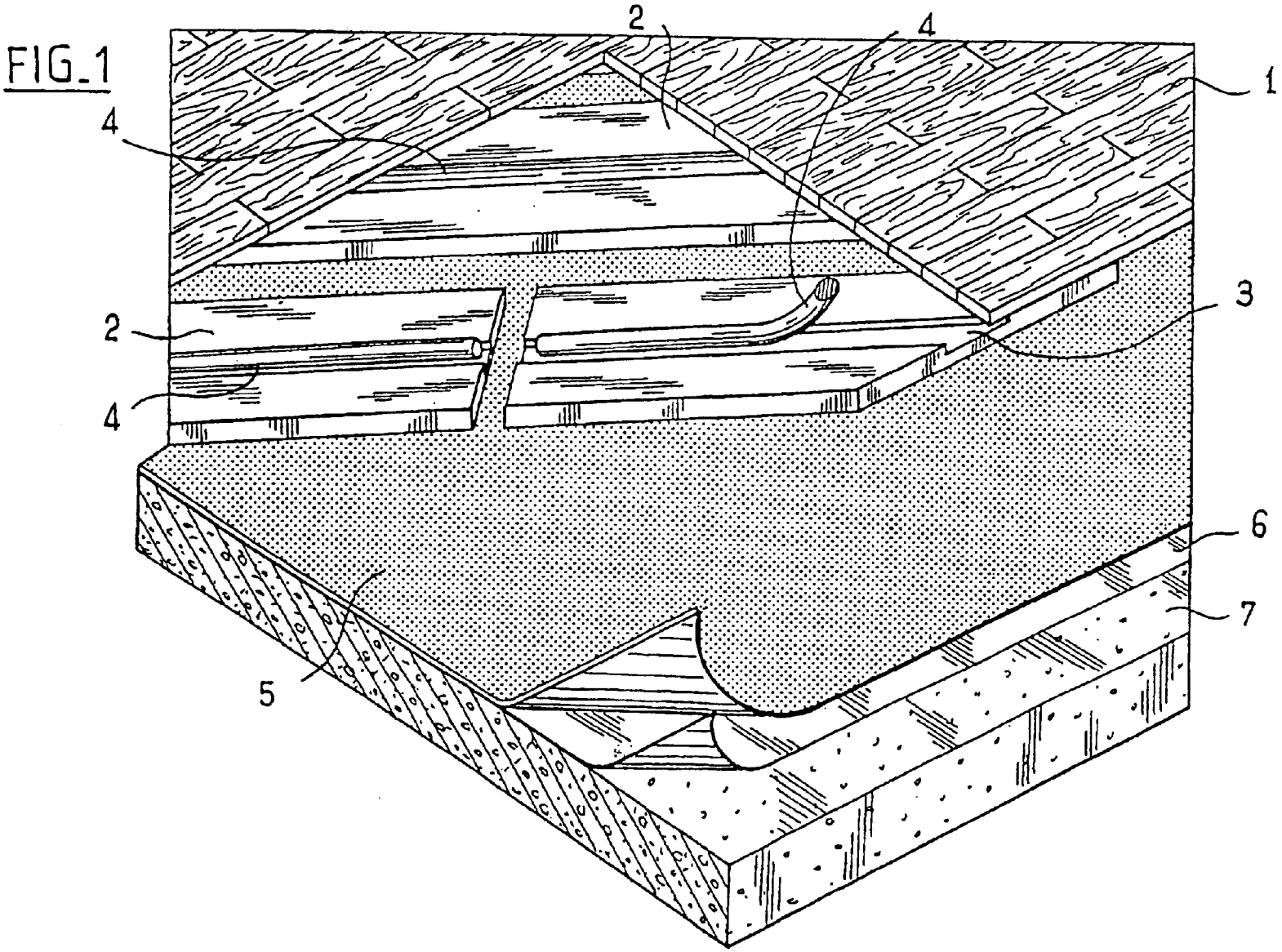
FIG. 1 is a diagrammatic, partially cutaway, perspective view of a first embodiment of the invention comprising multi-ply flooring.
Figure 2:
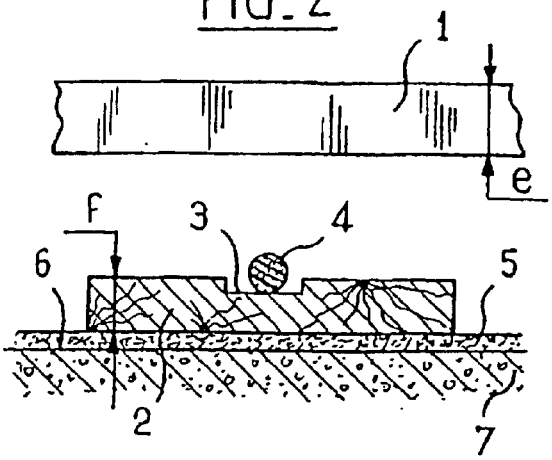
FIGS. 2 and 3 are fragmentary sections through the flooring on section plane II—II of FIG. 4, these two views showing the flooring respectively before and after a floorboard is laid on a load-spreading plate.

This type of adhesive is put into place easily and quickly using a glue-gun. FIG. 1 shows a bead 4 being deposited in the groove.

The bead of adhesive is initially in the form of an approximately cylindrical sausage of section selected to be smaller than the space available in the groove.

Figure 3:
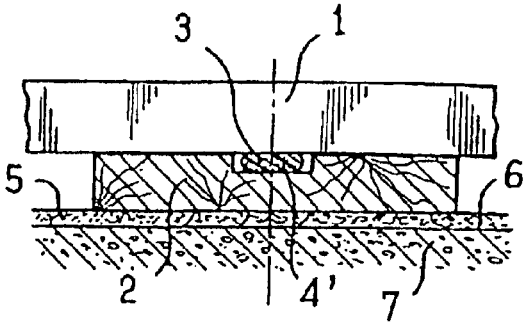

Thus, after being flattened, as can be seen in FIG. 3, the bead of adhesive, now referenced 4', occupies a fraction only of the section of the groove, or practically all of said section.

Once the adhesive has set, the bottom faces of the floorboards 1 can consequently press against the top faces of the plates 2, while simultaneously each floorboard is bonded to a plurality of underlying plates via their middle zones.

By means of these arrangement, the flooring is made cohesive with the various floorboards 10 being held pressed against each other via their adjacent edges because of the adhesive.

Nevertheless, the flexibility and the elasticity of the strip of adhesive, and the clearance that exists between the strip of adhesive and the groove in which it is received, leave the structure free to perform micro-displacements.

This phenomenon is illustrated in FIG. 4, where double-headed arrow F represents expansion and contraction in the surface area of the flooring in its own plane, in a direction that extends transversely relative to the floorboards.

It is this variation in surface dimension that leads to the risk of breakage in the longitudinal engagement by means of the tongue and groove system, and can also lead to spaces (gaps) appearing between certain floorboards.

By means of the invention, these problems are eliminated, with micro-displacements of the flooring relative to its underlying support being made possible by the elasticity of the strips of adhesive, thus ensuring that shrinkage observed between two adjacent floorboards does not accumulate within the flooring.

Furthermore, a degree of freedom in pivoting is also observed between the load-spreading plate 2 and the resilient underlayer 5, thereby contributing to eliminating internal tensions in the flooring.

These pivoting micro-movements of the plates 2 in a horizontal plane are symbolized by double-headed arrows G in FIG. 4.

It should be observed that document FR-2 317 062 has already disclosed reduced-expansion wooden flooring applied with adhesive.

That does not in any way constitute "floating" flooring of the kind to which the present invention relates.

On the contrary, the purpose of that prior flooring is to obtain a surface that is essentially monolithic by overcoming warping forces, if any.

The adhesive which is applied by means of a trowel is intended to provide purely "vertical" stability to the flooring (and the warping).

Although it is true that the adhesive can be initially deposited in the form of a layer with fluting, the fluting is flattened out when the floor is laid and the layer of adhesive takes on a uniform thickness (cf. page 7, last paragraph).

It is stated (at the top of page 8) that the layer is elastically damped, and that after setting, all lateral displacement or warping movements are avoided.

That flooring thus operates in a manner that is completely different from the present invention, in which:

the flooring is floating flooring, the load-spreading plates being placed on the ground via a resilient underlayer, and it is this underlayer, not the adhesive, which provides the flooring with damping;

the beads of adhesive allow the flooring to perform micro-displacements relative to the under-support, thus preventing shrinkage between adjacent floorboards accumulating; and a certain amount of freedom in pivoting for the load-spreading plates relative to the resilient underlayer contributes further to eliminating internal tensions.

It would not go beyond the ambit of the invention to place beads of elastically-deformable adhesive directly on the top faces of the plates rather than in grooves formed therein, even though that solution is less effective.

It would not go beyond the ambit of the invention to provide a plurality of parallel beads and/or beads disposed not in a continuous line but in an interrupted line (made up of separate segments, i.e. a dashed line) on the same plate, which line could be rectilinear or otherwise, for example it could be a zigzag line or an undulating line.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. Flooring with floating support, the flooring comprising a set of touching parallel floorboards supported by a set of mutually parallel load-spreading plates laid on the ground via a resilient underlayer on which said plates rest, said floorboards being stuck to said plates by means of beads of elastically-deformable adhesive disposed in longitudinal grooves formed in the top faces of the plates.

2. Flooring according to claim 1, wherein said beads of adhesive are made of polyurethane.

3. Flooring according to claim 1, wherein said grooves are substantially rectilinear in section, being dimensioned in such a manner that after the bead of adhesive has been flattened and has set, it occupies a fraction of the inside space of the groove in which it is received.

4. Flooring according to claim 1, wherein each plate is provided with a single middle groove.

5. Flooring according to claim 1, wherein said plates are oriented in such a manner as to form an acute angle relative to the longitudinal direction of the floorboards.

6. Flooring according to claim 5, wherein the angle has a value of about 45°.

7. Flooring according to claim 1, wherein the floorboards are assembled to one another by a tongue-and-groove engagement system.

8. Flooring according to claim 7, wherein said tongue-and-groove engagement system further includes gluing of mating tongues and grooves.

9. Flooring with floating support, the flooring comprising a set of touching substantially parallel floorboards supported by a set of mutually parallel load-spreading plates laid on the ground, said floorboards being stuck to said plates by beads of elastically-deformable adhesive disposed in a groove formed in a top face of each of the plates.

10. Flooring according to claim 9, wherein said beads of adhesive are made of polyurethane.

11. Flooring according to claim 9,wherein said grooves are substantially rectilinear in section, being dimensioned such that after the bead of adhesive has been flattened and has set, the adhesive occupies a fraction of the inside space of the groove in which it is received.

12. Flooring according to claim 9, wherein each plate is provided with a single longitudinally extending groove.

13. Flooring according to claim 9, wherein said plates are oriented in such a manner as to form an acute angle relative to the longitudinal direction of the floorboards.

14. Flooring according to claim 13, wherein the angle has a value of about 45°.

15. Flooring according to claim 9, wherein the floorboards are assembled to one another by a tongue-and-groove engagement system.

16. Flooring according to claim 15, wherein said tongue-and-groove engagement system further includes gluing of mating tongues and grooves.

* * * * *